US010010131B2

(12) United States Patent
Lewis et al.

(10) Patent No.: US 10,010,131 B2
(45) Date of Patent: Jul. 3, 2018

(54) FLOW INSOLE

(75) Inventors: Paul Lewis, Beeton (CA); David Bradley Granger, Lorena, TX (US); Jacob Martinez, Temple, TX (US); William Sterling Wynn, Crawford, TX (US)

(73) Assignee: IMPLUS FOOTCARE, LLC, Durham, NC (US)

( * ) Notice: Subject to any disclaimer, the term of this patent is extended or adjusted under 35 U.S.C. 154(b) by 1516 days.

(21) Appl. No.: 13/363,296

(22) Filed: Jan. 31, 2012

(65) Prior Publication Data

US 2012/0192452 A1 Aug. 2, 2012

Related U.S. Application Data

(60) Provisional application No. 61/438,963, filed on Feb. 2, 2011, provisional application No. 61/509,979, filed on Jul. 20, 2011.

(51) Int. Cl.

| | |
|---|---|
| ***A43B 7/00*** | (2006.01) |
| ***A43B 17/00*** | (2006.01) |
| ***A43B 17/08*** | (2006.01) |
| ***A43B 17/10*** | (2006.01) |
| ***A43B 17/14*** | (2006.01) |

(Continued)

(52) U.S. Cl.

CPC ..... *A43B 7/005* (2013.01); *A43B 7/06* (2013.01); *A43B 13/38* (2013.01); *A43B 17/006* (2013.01); *A43B 17/08* (2013.01); *A43B 17/102* (2013.01); *A43B 17/14* (2013.01)

(58) Field of Classification Search

USPC ..... 36/44, 43, 92, 2.6, 3 R

See application file for complete search history.

(56) References Cited

U.S. PATENT DOCUMENTS 2,284,947 A 6/1942 Clifford
3,475,836 A * 11/1969 Brahm ..... 36/3 R (Continued)

FOREIGN PATENT DOCUMENTS

WO WO 2009068298 A1 * 6/2009

OTHER PUBLICATIONS http://www.instantarches.com/cool-soles.shtml. Printed Jan. 22, 2013.

(Continued)

*Primary Examiner* — Megan Lynch

(74) *Attorney, Agent, or Firm* — Buchanan Ingersoll & Rooney PC

(57) ABSTRACT

An insole which generates an air flow during use, which assists in cooling or warming the foot of a user is disclosed. In a first embodiment, air flow facilitated by said insole provides for convective heat transfer away from the plantar surface of the foot. The insole is intended for insertion into a shoe which is ventilated, preferably an athletic shoe with a ventilated upper. The bottom layer defines a plurality of ridges and a channel lining portion which together define a plurality of air channels. The bottom layer defines a heel recess in which a heel pad is situated. In a second embodiment, an insole which collects, retains, and heats and to a user's foot is disclosed. Said insole further comprises a middle layer of thermal reflective material secured to and coextensive with a top layer and a bottom layer secured to said middle layer.

31 Claims, 11 Drawing Sheets

(51) Int. Cl.
*A43B 7/06* (2006.01)
*A43B 13/38* (2006.01)

(56) References Cited

U.S. PATENT DOCUMENTS

| | | | | | |
|---|---|---|---|---|---|
| 4,071,963 | A | | 2/1978 | Fukuoka | |
| 4,215,492 | A | | 8/1980 | Sandmeier | |
| 4,309,831 | A | | 1/1982 | Pritt | |
| 4,546,555 | A | | 10/1985 | Spademan | |
| 4,633,597 | A | | 1/1987 | Shiang | |
| 4,729,179 | A | | 3/1988 | Quist, Jr. | |
| 4,813,160 | A | | 3/1989 | Kuznetz | |
| 4,860,463 | A | * | 8/1989 | Pin | 36/3 B |
| 4,887,368 | A | | 12/1989 | Latzke | |
| 4,974,342 | A | | 12/1990 | Nakamura | |
| 5,010,661 | A | | 4/1991 | Chu | |
| 5,025,575 | A | | 6/1991 | Lakic | |
| 5,035,068 | A | * | 7/1991 | Biasi | 36/3 R |
| D324,761 | S | | 3/1992 | Soo-Kwan | |
| 5,138,775 | A | | 10/1992 | Chu | |
| 5,224,277 | A | * | 7/1993 | Sang Do | 36/27 |
| 5,282,324 | A | | 2/1994 | Cheng | |
| 5,333,397 | A | | 8/1994 | Hausch | |
| 5,392,533 | A | * | 2/1995 | Gerhartl | 36/43 |
| 5,400,526 | A | | 3/1995 | Sessa | |
| 5,443,529 | A | | 8/1995 | Phillips | |
| 5,509,938 | A | | 4/1996 | Phillips | |
| 5,572,804 | A | * | 11/1996 | Skaja et al. | 36/29 |
| 5,584,130 | A | * | 12/1996 | Perron | 36/44 |
| 5,675,914 | A | * | 10/1997 | Cintron | 36/3 B |
| 6,041,519 | A | * | 3/2000 | Cheng | 36/3 R |
| 6,079,123 | A | | 6/2000 | Clark | |
| 6,266,897 | B1 | * | 7/2001 | Seydel et al. | 36/29 |
| 6,425,195 | B1 | | 7/2002 | Donzis | |
| 6,553,690 | B2 | | 4/2003 | Di Girolamo | |
| 6,581,303 | B1 | * | 6/2003 | Tuan | 36/3 B |
| D485,426 | S | | 1/2004 | Di Girolamo | |
| 6,671,979 | B2 | | 1/2004 | Cardarelli | |
| 6,967,044 | B1 | * | 11/2005 | O'Brien | 428/35.7 |
| 7,316,081 | B1 | * | 1/2008 | Cheng | 36/3 R |
| 7,437,836 | B2 | | 10/2008 | Kim | |
| 7,712,229 | B2 | | 5/2010 | Yang | |
| 8,241,450 | B2 | * | 8/2012 | Hensley et al. | 156/145 |
| 2004/0118017 | A1 | * | 6/2004 | Dalton et al. | 36/44 |
| 2004/0168354 | A1 | * | 9/2004 | Nguyen | 36/43 |
| 2005/0262736 | A1 | * | 12/2005 | Peoples | 36/44 |
| 2006/0016099 | A1 | * | 1/2006 | Marco et al. | 36/43 |
| 2006/0130367 | A1 | * | 6/2006 | Liu | 36/55 |
| 2006/0168846 | A1 | * | 8/2006 | Juan | 36/3 B |
| 2006/0254088 | A1 | * | 11/2006 | McCormick | 36/44 |
| 2008/0028637 | A1 | * | 2/2008 | Benfatti | 36/43 |
| 2009/0100722 | A1 | * | 4/2009 | Hoffer et al. | 36/3 R |
| 2010/0015869 | A1 | * | 1/2010 | Hartmann et al. | 442/59 |
| 2010/0083534 | A1 | * | 4/2010 | Howlett | 36/44 |
| 2010/0170116 | A1 | | 7/2010 | Shim | |
| 2010/0205831 | A1 | * | 8/2010 | Cheskin et al. | 36/44 |
| 2010/0218398 | A1 | * | 9/2010 | Reinhardt et al. | 36/44 |
| 2010/0251577 | A1 | * | 10/2010 | Yamada | 36/25 R |
| 2011/0209360 | A1 | * | 9/2011 | Baker et al. | 36/44 |
| 2011/0219642 | A1 | * | 9/2011 | Sulak et al. | 36/44 |
| 2011/0232129 | A1 | * | 9/2011 | Roberts et al. | 36/88 |
| 2011/0302805 | A1 | * | 12/2011 | Vito | 36/44 |

OTHER PUBLICATIONS http://www.geldoctor.com/flosole.html. Printed Jan. 22, 2013.
http://www.superfeet.com/products/REDHot.aspx. Printed Jan. 22, 2013.
http://www.thermosoles.com/. Printed Jan. 22, 2013.
http://gerbing.com/Products/insoles.php. Printed Jan. 22, 2013.
https://www.warmers.com/grabber-foot-warmers-medium-5-hour-10-pair-bundle/. Printed Jan. 22, 2013.
http://www.heatfactory.com/english/product.php?cat=3&id=31. Printed Jan. 22, 2013.
http://www.meanandgreen.com/army/-/Thermal_Foil_Insoles/2660/2303.html. Printed Jan. 22, 2013.
http://www.footscience.com/products_foot.htm. Printed Jan. 22, 2013.

* cited by examiner

FLOW INSOLE

CROSS REFERENCE TO RELATED APPLICATIONS

This application claims the benefit of provisional applications 61/438,963 filed Feb. 2, 2011 and 61/509,979 filed Jul. 20, 2011.

STATEMENT REGARDING FEDERALLY SPONSORED RESEARCH OR DEVELOPMENT

Not applicable.

TECHNICAL FIELD

This invention relates to the field of replacement insoles for shoes.

BACKGROUND

Shoes, particularly athletic shoes, generally have an insole placed within the foot-receiving compartment when sold. The insole is positioned so that the user's foot will rest thereon while wearing the shoe. Generally, such insoles are removable and may be replaced with insoles which may employ various features of benefit to the user or the particular needs of the user's feet.

Wearing shoes may cause the temperature of the wearer's feet to rise. The feet can even become hot, particularly if the wearer is exercising. A normal bodily reaction to overheating is sweating. Thus, on occasion, a user's foot is hot and releases fluid in the form of sweat. While the foot is wearing the shoe, the heat and sweat can cause discomfort, odor, and other undesirable results.

On other occasions, in certain weather conditions, or due to the nature of a user's body temperature, feet can become chilled even while wearing shoes and additional warmth to the feet is needed.

DETAILED DESCRIPTION

Figure 1:
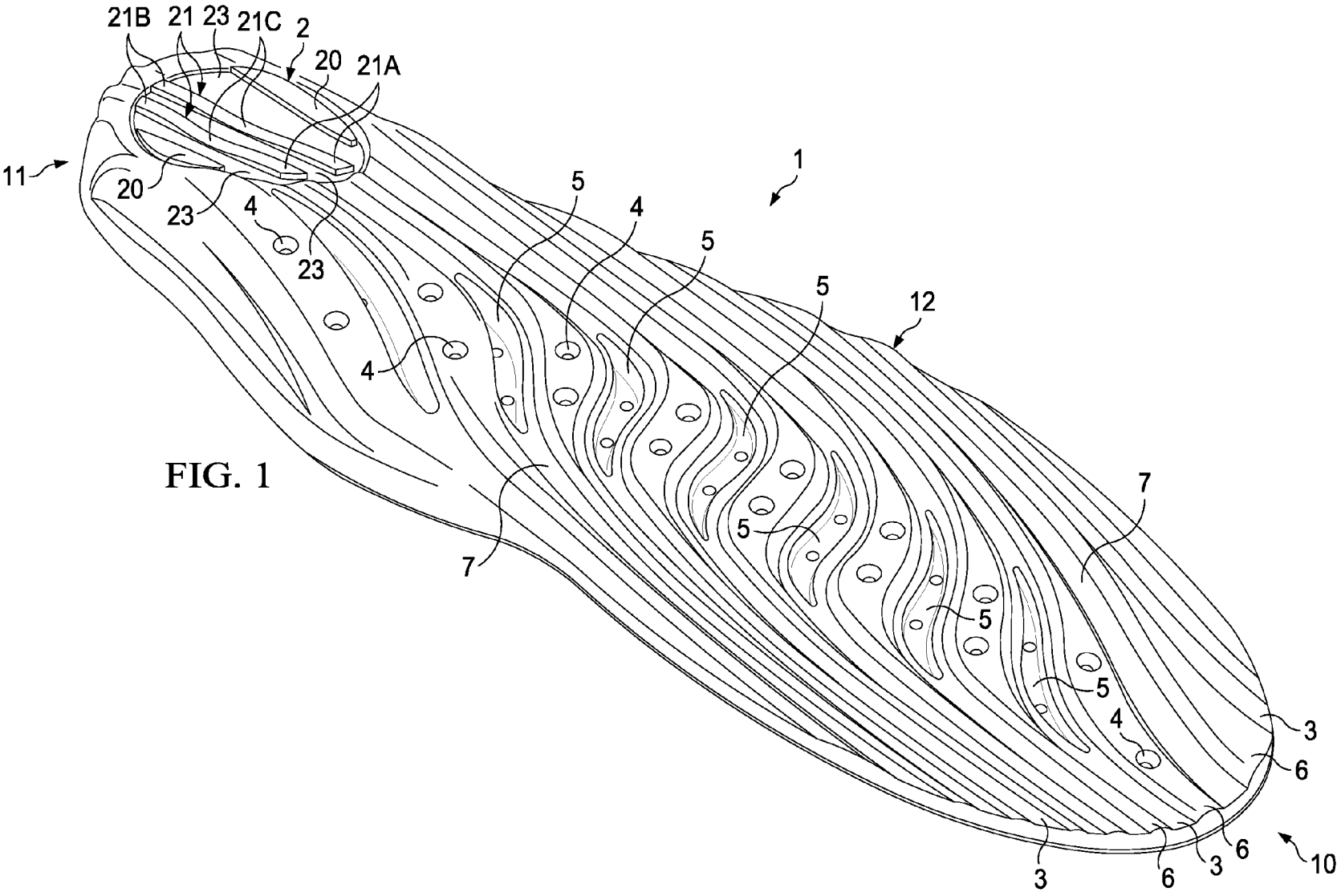
FIG. 1 is a perspective view of an embodiment of the present invention designed for cooling the right foot of a wearer.

An insole is now described which has a structure which addresses the heat and sweat released by a wearer's foot by enabling generation of an air flow which assists in convective heat transfer away from the plantar surface of the foot. This heat transfer causes the user's foot to feel cooler, and thus the body's natural tendency to sweat is also reduced. In preferred embodiments, the materials used for the insole structures increase heat transfer away from the foot. An alternate embodiment, which has a construction that enhances heat retention to help warm a user's foot, utilizes the generated air flow to help circulate the warm air.

The insole is adapted to be placed inside a user's shoe during use. Preferably, the insole is used to replace rather than augment any insoles that may already reside in the user's shoe.

The insole has a top side which is a substrate for foot contact and a bottom side which lies adjacent the inside of the user's shoe during use.

A first embodiment of the insole for cooling the feet during use preferably comprises at least two layers, a top layer and a bottom layer. The top layer serves as the substrate for foot contact by the user and preferably consists of a fabric or cloth that assists in thermal regulation of the foot. Preferably, the top layer is a cloth material useful in controlling the relative humidity in the shoe and is constructed of moisture wicking material to assist in moving moisture (perspiration) to the outer edges of the insole. The moisture can then be transferred to the shoe exterior and/or exposed to air for evaporative cooling.

A second embodiment of the insole for warming the feet during use preferably comprises a top layer, a middle layer and a bottom layer. The top layer preferably consists of a fabric or cloth that assists in thermal regulation of the foot. Preferably, the top layer is a fabric which has temperature regulating properties. This top layer interacts with the skin temperature of a user's foot to provide a buffer against temperature variations. The fabric preferably absorbs and stores excess heat from the feet, then can release the heat when needed to warm the feet. Preferably, the fabric is 100% polyester and incorporates a phase change material available from Outlast Technologies, Boulder, Colo.

In a less preferred embodiment, the insole has a single layer having the structure of the bottom layer described herein. In such case, the substrate for foot contact by the user is a top surface of the single layer, which single layer has a structure identical to that of the preferred cooling embodiment illustrated in FIG. 3 except for lacking a separate top layer Henceforth, it should be understood that the bottom layer of the first embodiment and the single layer of the less preferred embodiment have the same structure. The second embodiment for foot warming may be altered so as not to employ a top layer and will comprise two instead of three layers in such circumstances. The structure will be referred to as the bottom layer regardless of whether it is a single layer, a second layer or a third layer of the insole.

For said first embodiment, preferably a cooling textile which contains a special low temperature jade obtained from a natural source is employed for the top layer. The form of jade in the textile is a jadeite.

The bottom layer of the first embodiment insole is preferably comprised of a thermally conductive material which assists in the transfer of heat away from the foot. One suitable material is thermally conductive ethylene vinyl acetate ("EVA"). To provide thermally conductive properties to the EVA, magnesium oxide (MgO) can be incorporated as a filler. Approximately 12% MgO provides desired thermally conductive properties, but lesser or greater amounts of filler can be used as long as the amount does not adversely affect EVA molding or stability. Thermally conductive material provides an efficient path for heat as the heat travels from the plantar surface of the foot to the interface between the insole and the shoe. At this interface, heat is dissipated by convection, conduction and radiation.

Other materials besides thermally conductive EVA can be used for the bottom layer as well, but if a thermally conductive material is used, the overall performance of the insole is improved because heat can be transferred from a user's foot to the material more quickly and efficiently. Other fillers instead of or in addition to MgO could be employed to provide the EVA with the thermally conductive properties. An example of another filler is boron nitride.

The hardness of the EVA material is preferably about 45 Asker C±3. An appropriate hardness is provided so that the insole supports the foot at a rest position (i.e. when a user is standing on the insole as positioned in the user's footwear and the air channels are essentially uncollapsed) but so that the air channels are able to collapse when increased pressure is applied as when the user walks or runs.

For said second embodiment, the insole preferably comprises a top layer, a middle layer and a bottom layer. The top layer is a substrate for foot contact by the user and preferably consists of a fabric or cloth that assists in thermal regulation of the foot. Preferably, the top layer is a fabric which has temperature regulating properties. This top layer interacts with the skin temperature of a user's foot to provide a buffer against temperature variations. The fabric preferably absorbs and stores excess heat from the feet, then can release the heat when needed to warm the feet. Preferably, the fabric is 100% polyester and incorporates a phase change material available from Outlast Technologies, Boulder, Colo.

An antimicrobial treating material may be incorporated into the top layer or used to treat it. A preferred antimicrobial treating material is available from Aegis Environmental Management (USA). The Aegis® Microbe Shield technology forms a solid structure of polymer spikes that ruptures the cell walls of odor-causing microbes, rendering them ineffective. The technology can be infused into all materials that come into direct contact with the foot.

Alternatively, a chemical or biological agent may be used to treat the top layer for odor and/or antimicrobial resistance.

Adjacent to and coextensive with the top layer of the second embodiment is a middle layer comprising a thermal reflective barrier. This layer may be a reflective foil layer, preferably an ultra-thin foil layer. The middle layer helps capture and retain heat in the insole. Alternatively, a secondary middle layer may be used adjacent to said top layer and said middle layer to aid with the adhesion of the layers. The secondary middle layer is preferably an EVA layer of about 1.5 mm.

The bottom layer of the second embodiment of the insole is preferably made of an insulated base material. An appropriate insulated base material is Ethylene vinyl acetate (also known as EVA) is the copolymer of ethylene and vinyl acetate. Another material that can be used is polyurethane foam or "PU" foam. The base material should also be selected to provide support for the user's foot, particularly arch support. The bottom layer has a heel portion, an arch portion, and a toe portion.

Now turning to the Figures, it should be understood that in the usual case, a user will employ a pair of insoles in a given pair of shoes—one for the right shoe/foot and one for the left/shoe foot. The right and left insoles are mirror images of each other so that they adapt to a typical user's right and left shoes and feet. For purposes of illustration, a right insole is depicted in the Figures and it should be understood that a corresponding left insole is within the scope of the invention and the left insole is a mirror image of the right insole.

A typical user of insole will install it as a replacement insole in a shoe with portions of bottom layer resting on the inner bottom surface of a shoe, leaving top layer visible to the user before donning the shoe. The user will don the shoe in a typical manner at which time the user's foot will be in direct or indirect contact with top layer, depending whether or not the user also wears socks or hosiery whereupon indirect contact will occur.

Figure 2:
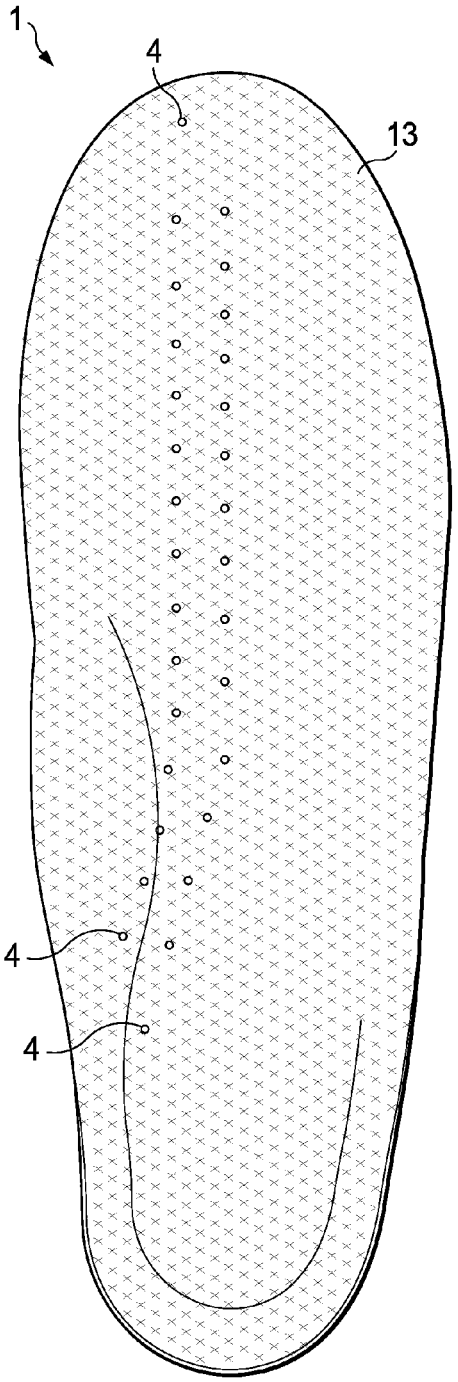
FIG. 2 is a top view of an embodiment of the present invention designed for cooling the right foot of a wearer.
Figure 3:
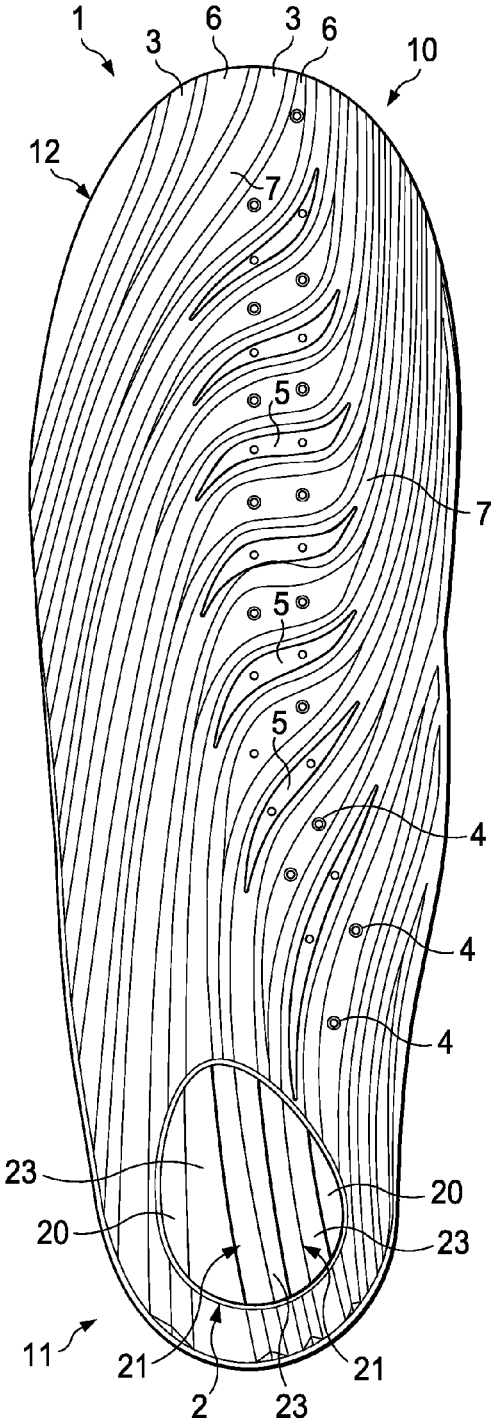
FIG. 3 is a bottom view of an embodiment of the present invention designed for cooling the right foot of a wearer.
Figure 4:
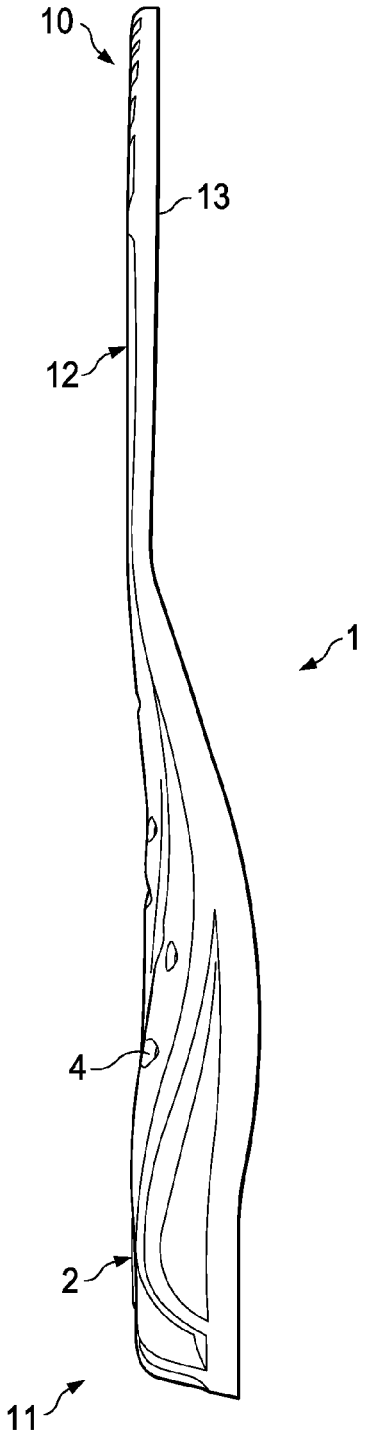
FIG. 4 is a left side view of an insole designed for cooling the right foot of a wearer.
Figure 5:
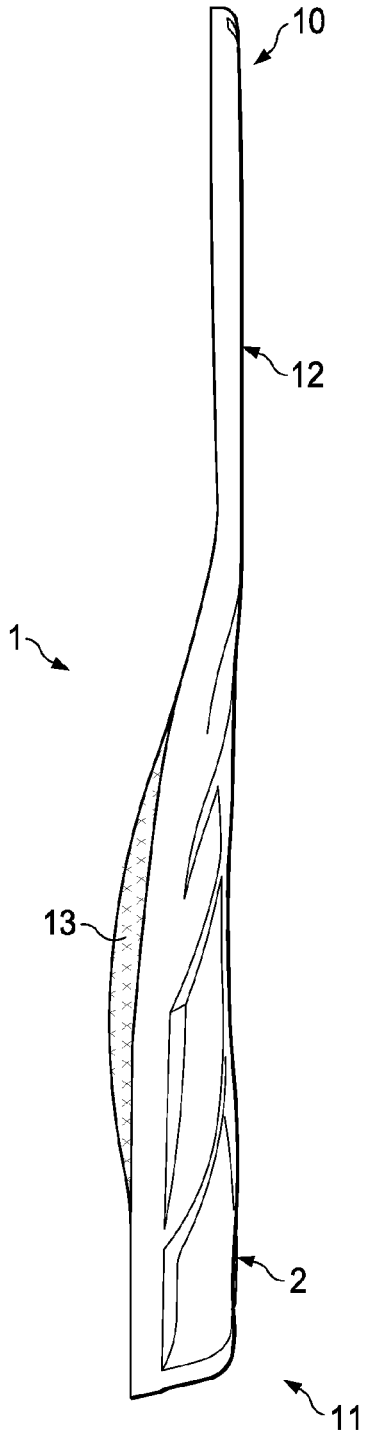
FIG. 5 is a right side view of an insole designed for cooling the right foot of a wearer.
Figure 6:
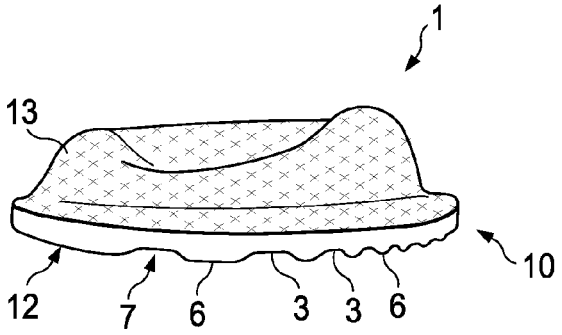
FIG. 6 is front side view of the forefoot area of an embodiment of the present invention designed for cooling the right foot of a wearer.

Now referring to said first embodiment designed for cooling the feet, the preferred insole (1) has a top layer, as best seen in FIGS. 2 and 6, (13) on which a user will rest his or her foot during use. Bottom layer (12), best seen in FIGS. 1, 3, 4, 5 and 6, is placed adjacent the inside bottom surface of a user's shoe during use. Referring to FIGS. 3 and 4, bottom layer (12) has a heel portion (11) and a toe portion (10). Bottom layer (12) defines a heel recess in heel portion (11) of sufficient depth and configuration so as to be adapted to receive concave heel pad (2) as illustrated in FIG. 3. Bottom layer (12) defines ridges (6), best seen in FIGS. 1, 3, 6 and 7 which protrude outwardly therefrom, and extend essentially lengthwise from the heel portion (11) to the toe portion (10). A plurality of air channels (7) are defined by adjacent ridges (6) and a channel lining portion (3) of the bottom layer (12) as best seen in FIGS. 1, 3 and 6 near toe portion (10). When insole (1) is placed adjacent the inside bottom surface of a user's shoe, a portion of the ridges (6) contact the inside shoe surface, thus sealing air channels (7) against that surface and forming individual pathways in which air can travel from a first location to a second location within said air channels. In a preferred embodiment of said first embodiment, heel pad (2) is concave and at least some of the air channels (7) of insole (1) are in communication with heel pad (2). This is best seen in FIGS. 1 and 3.

The configuration of the air channels (7) preferably maximizes the flow of air. The configuration is determined by ridges (6). Along one or more of the air channels (7) is an elongated recess (5) defined by the bottom layer (12). Preferably, the bottom layer (12) and top layer (13) together define air vent holes (4) which extend through both layers allowing communication of heated air, vapor/moisture and/or odiferous air from the user's foot to the area beneath insole (1). The air vent holes (4) work in conjunction with the air channels (7) to move air to and from the plantar surface of the foot.

In a preferred embodiment of said first embodiment, air vent holes (4) have a conical configuration. The widest portion of the conical air vent hole is adjacent the bottom layer (12) (See air vent hole (4) in FIG. 3) and the narrowest portion near the top layer (See air vent hole 4 in FIG. 2). The conical configuration maximizes the amount of air flow from the bottom to the top of the insole through air vent hole (4).

The projected air passing through the channel lining portion (3) combines with the heat/moisture/odiferous air in the recess (5) and then is forced by the motion of the user's heel strike and toe. Each recess (5) allows more heat/moisture/odiferous air to be transferred from the underside of the foot to the bottom of the insole (1), where this air will temporarily reside until a subsequent stream of air flows by and sweeps the air temporarily residing in the recess(es) (5) along the air channel (7).

In an alternative embodiment of said insole for cooling, no recesses or air vent holes are employed. It should be understood that one may employ recesses with air vent holes as shown in FIG. 3, recesses without air vent holes, or the alternative embodiment with no recesses or air vent holes. Although the recesses and air vent holes aid in the air flow, the insole and its channels defined on the bottom of the insole have efficacy without these additional structures.

Preferably, the first embodiment of the insole, used for cooling, will be used with athletic performance shoes which are ventilated on the shoe upper, which permit air to enter and be exhausted from a shoe during wear. Users will then typically walk or run while wearing the shoe containing the insole (1). During a walking or running motion, a user typically first makes contact with the ground with the heel of his or her shoe ("a heel strike"), then rocks the foot forward so that the toe portion of the shoe contacts the ground, whereupon the heel then begins to lift off the ground. The motion concludes with only the toe portion of the shoe in contact with the ground ("toe off".) During this typical motion of walking or running, the concave heel pad (2) is compressed by the heel strike, thus creating a displacement of air. As air is displaced, it is projected away from the heel portion (11) of the insole toward the toe portion (10) of the insole through the air channels (7). As the user's foot progresses from heel strike to toe off, the channel lining portion (3) and/or the ridges (6) collapse under the weight of the user, thereby temporarily eliminating the discreet air channels (7) under insole (1). This causes air to displace in the direction of toe portion (10). Air then circulates to the dorsal (top) of the foot where convective heat transfer will occur. The air that moves to the top of the shoe can either dissipate through the top or sides of the shoe or continue to reside in the shoe. The channels on the bottom direct airflow. Channels are preferably configured to follow the natural gait curve/path. By this it is meant that a typical gait will put pressure on the insole first on the lateral heel area and as the weight of the foot shifts to the forefoot/toes the gait shifts to the medial side of the insole. The big toe then is the greatest participant in "toe off" which is the pushing off the ground to advance the foot forward.

Heel pad (2) provides for increased cushioning of the heel upon heel strike by the user. Preferably, heel pad (2) is concave. Most preferably, heel pad (2) has outside heel ridges (20), inside heel ridges (21) and heel channel portions (23).

When heel pad (2) is concave and provided with heel ridges as described above, and positioned in the heel recess defined by bottom layer (12), the heel channel portions are essentially coplanar with the channel lining portions (3) of the bottom layer (12).

Each inside heel ridge (21) is preferably essentially curvilinear in shape and has a front end (21A), a back end (21B) and a middle portion (21C). The front end (21A) and back end (21B) each have a sufficient thickness so that when the concave heel pad is in place in said heel recess, each of said front and back ends of the inside heel ridges thereof are situated adjacent the ridges (6) of bottom layer (12), and they are of similar thickness to ridges (6) and appear essentially continuous. The middle portion (21C) of the inside heel ridges (21) comprises the top of the curvilinear shape when the insole is in use and is of a thickness less than that of the ends, so the curve gradually changes in thickness. It has a greatest thickness at the ends and the least thickness at the middle portion. The outside heel ridges (20) each have a front and back end and maintain the same thickness from said front end to said back end.

The preferred curvilinear shape of the inside heel ridges (21) is advantageous because it allows for more compression. The added compression can assist in providing more comfort/cushioning and allow more air to be displaced by a heel strike of a user. The shape formed is a cup-like area in which air may accumulate prior to the heel strike of the user. The heel pad is replenished by air drawn from around the edges of the insole. If the heel pad is compressed from the center, then air can effectively be displaced in two directions.

Most preferably, the heel pad is made of a polyurethane ("PU") material. In a most preferred embodiment, the heel pad layer measures 45 Asker C±3. Alternative materials such as thermoplastic resin (TPR) gel can be used for the heel pad to provide desired cushioning of the heel.

Referring to FIG. 3, the preferred configuration for the air channels (3) and ridges (6) is shown. A preferred concave heel pad (2) is illustrated as secured to insole (1) within the recess defined by heel portion (11).

FIGS. 4 and 5 show the side views of insole (1). The same numbers corresponding to the parts defined in the top and bottom views are provided for clarification of position.

Referring to FIG. 6, a front view of the insole (1) is shown and toe portion (10) is a reference point. In this view, the layers of the insole (1) are best seen. The top layer (13) is secured to the bottom layer (12) side opposite the ridges (6) and channel lining portions (3) are shown. The channel lining portions (3) define the openings which are air channels (7) and these are in open communication with the interior of the shoe when in use.

Figure 7:
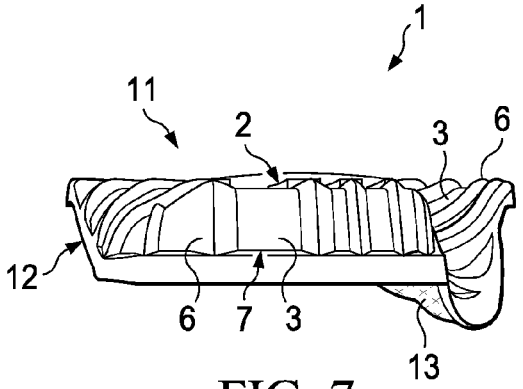
FIG. 7 is back side view of the heel area of an embodiment of the present invention designed for cooling the right foot of a wearer.

Referring to FIG. 7, the heel portion (11) is shown from an end view of insole 1). The heel portion (11) has a shape suitable to support and cradle the heel of a user and prevent it from rolling or sliding within the shoe. The ridges are the continuation of the channels.

Figure 8:
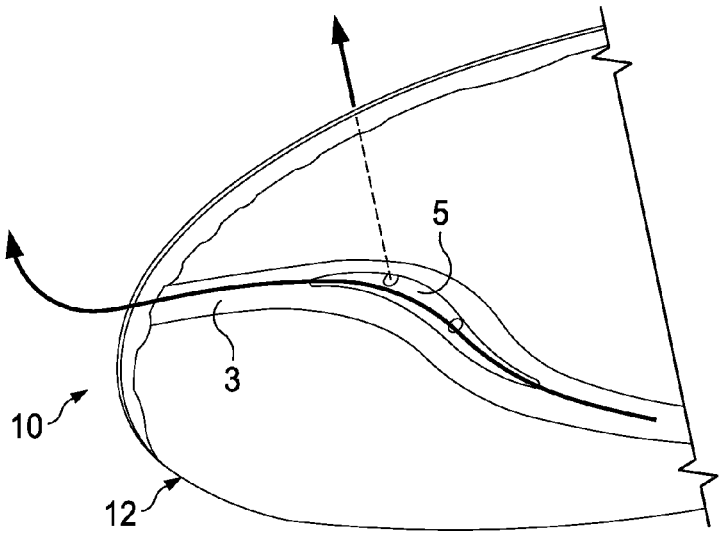
FIG. 8 is an illustrative view of a pathway air may travel.

Referring to FIG. 8, a pathway along channel lining portion (3) acts as a pathway for air movement. Air may also travel through air vent holes (4) along said pathway.

Figure 9:
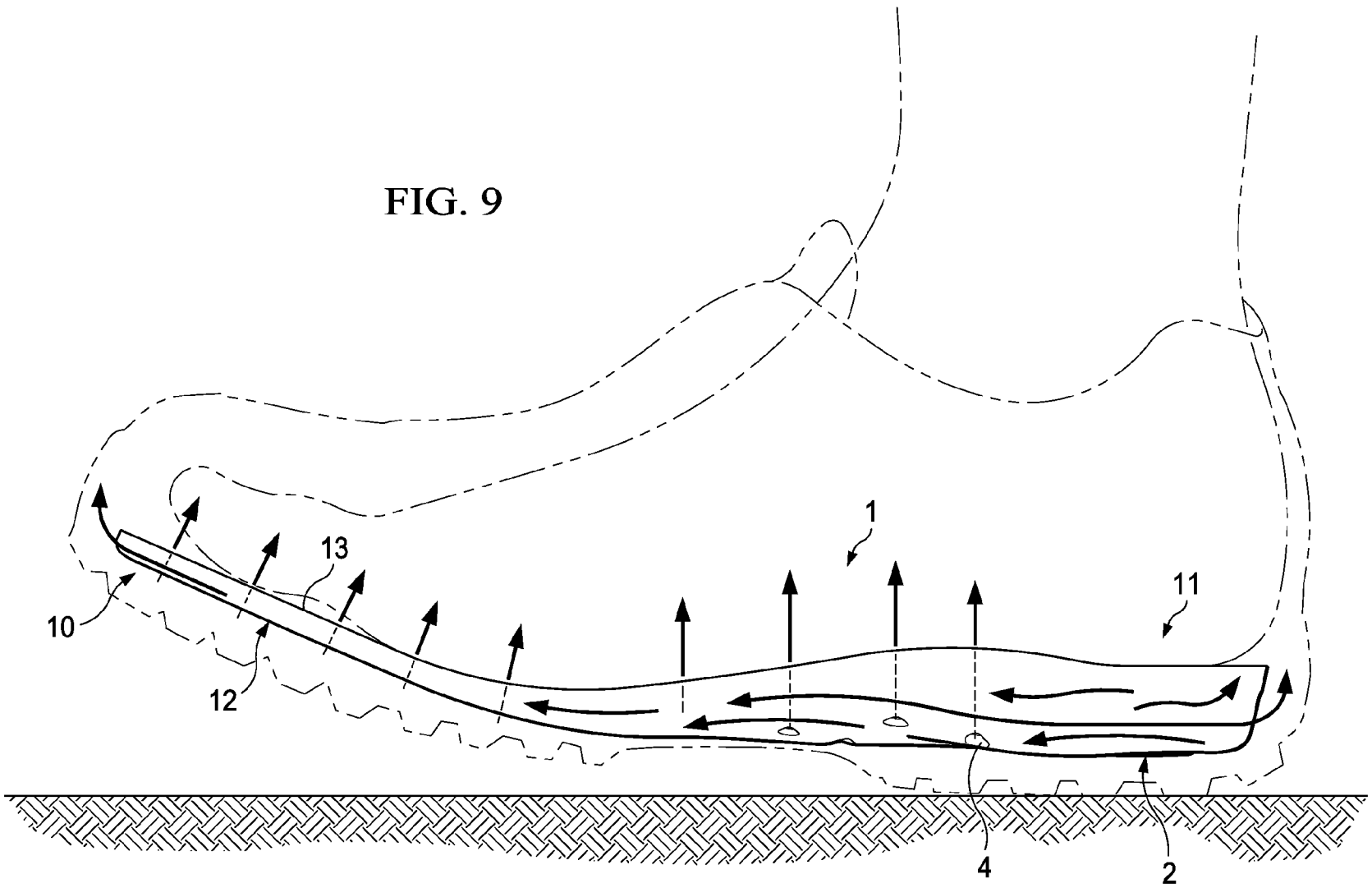
FIG. 9 is an environmental view illustrating air pathways initiated by a heel strike.

FIG. 9 illustrates an environmental view of the insole inside a shoe in use. Upon heel strike, air is pushed toward the heel portion (10) and toe portion (11) of the insole and up around the edges of the insole towards the user's foot. Air may also travel through air vent holes (4) along the pathways.

Most preferably, the concave heel pad of the cooling embodiment is made of a polyurethane ("PU") material. In a most preferred embodiment, the heel pad layer measures 45 Asker C±3. Alternative materials such as thermoplastic resin (TPR) gel can be used for the heel pad to provide desired cushioning of the heel.

The insole of the present invention is made by a process of providing a bottom layer and a heel pad. In a preferred embodiment, a top layer is secured to the bottom layer.

The bottom layer is preferably an ethylene vinyl acetate (EVA) material with magnesium oxide (MgO). One way of creating the EVA bottom layer is to mix an EVA resin with the MgO and a foaming agent and mold it into a block or bun. The bun is sliced into thin flat sheets and then a top cloth fabric (top layer) is adhered to the said thin flat sheets. Sheets are cut to smaller panel sizes to fit compression molds. The EVA/MgO panels are inserted into compression molds with impression of the insole and compressed at a predetermined time, temperature, and pressure appropriate for the material being used. The formed panel is then removed and excess material is trimmed leaving the insole.

The heel pad is preferably a polyurethane (PU) material. One way of making the heel pad is to mix the PU components and pour the mixture into an open mold cavity having the configuration of the desired heel pad. The mold cavity is then closed and the mixture allowed to cure. The cured heel pads are then removed from the mold and excess material is trimmed.

One way to assemble the described bottom layer and heel pad is to apply adhesive to the heel pad cavity and the heel pad flat surface to mate with the bottom layer. The adhesives are activated and the heel pad positioned in the heel pad cavity and pressure applied to secure it in place.

Figure 10:
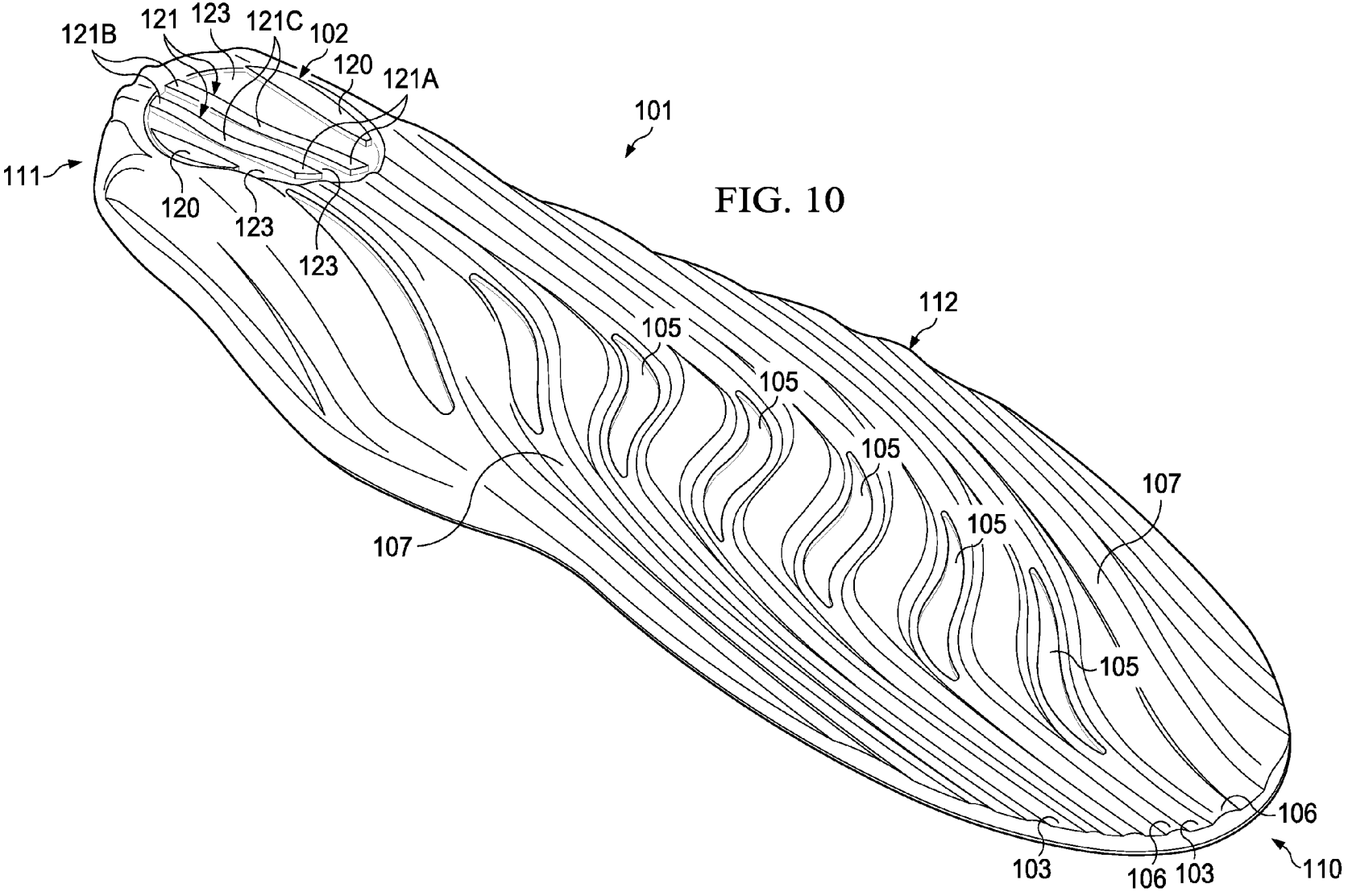
FIG. 10 is a perspective view of an embodiment of the present invention designed for warming the right foot of a wearer.
Figure 12:
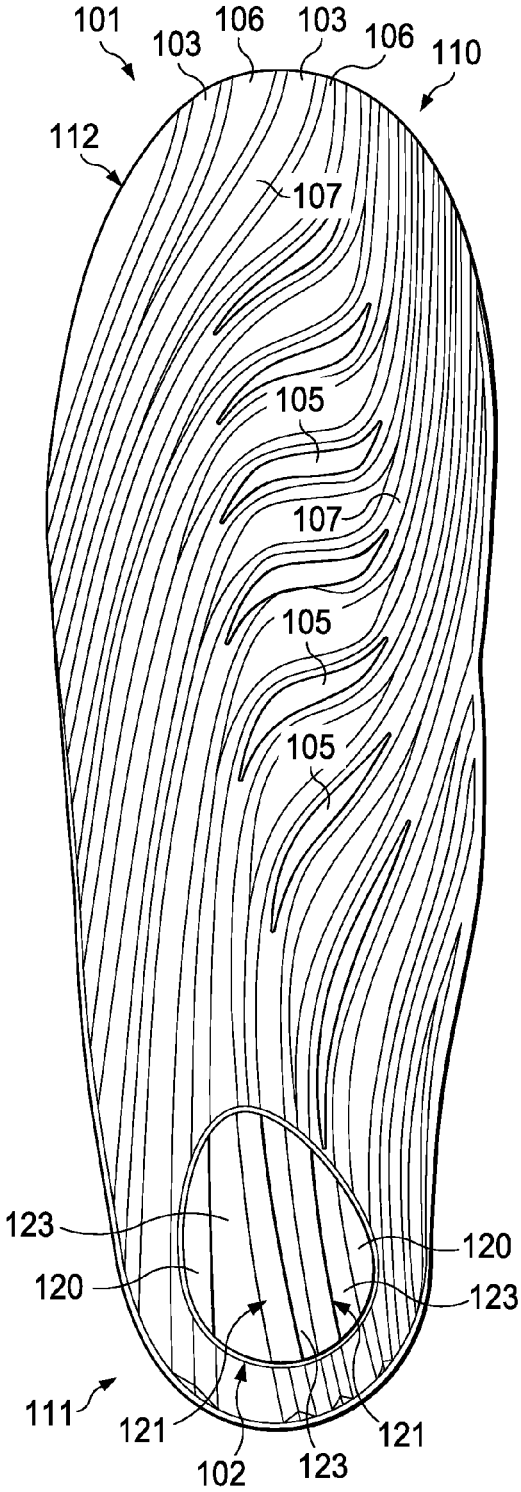
FIG. 12 is a bottom view of an embodiment of the present invention designed for warming the right foot of a wearer.
Figure 15:
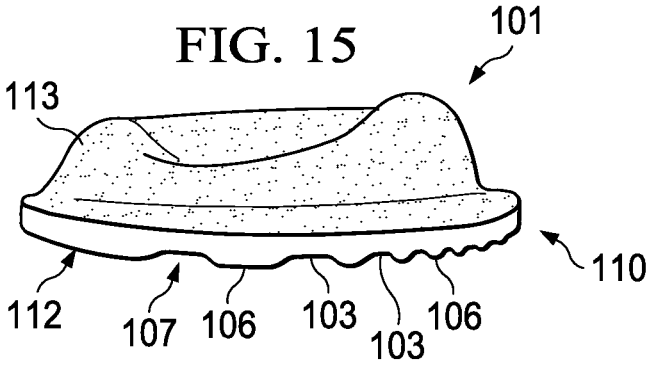
FIG. 15 is front side view of the forefoot area of an embodiment of the present invention designed for warming the right foot of a wearer.

Now referring to said second embodiment of the insole designed for warming the feet, bottom layer (112) has a heel portion (111) and a toe portion (110), as seen in FIGS. 10 and 12. Bottom layer (112) defines a heel recess in heel portion (111) of sufficient depth and configuration so as to be adapted to receive concave heel pad (102) as illustrated in FIG. 12. Bottom layer (112) defines ridges (106), best seen in FIGS. 10, 12, 15 and 16 which protrude outwardly therefrom, and extend essentially lengthwise from the heel portion (111) to the toe portion (110). A plurality of air channels (107) are defined by adjacent ridges (106) and a channel lining portion (103) of the bottom layer (112) as best seen in FIGS. 10, 12 and 15 near toe portion (110). When insole (101) is placed adjacent the inside bottom surface of a user's shoe, a portion of the ridges (106) contact the inside shoe surface, thus sealing air channels (107) against that surface and forming individual pathways in which air can travel from a first location to a second location within said air channels. At least some of the air channels (107) of insole (101) are in communication with a concave heel pad (102). This is best seen in FIGS. 1 and 3.

The configuration of the air channels (107) preferably maximizes the flow of air. The configuration is determined by ridges (106). Along one or more of the air channels (107) is an elongated recess (105) defined by the bottom layer (112). The recesses (105) help provide more air flow in the air channels (107) by pushing more air through the air channels (107) when compressed and pulling more air in when decompressed.

Preferably the second embodiment of the insole, used for warming, will be used with less ventilated shoe uppers.

In an alternative embodiment of said insole for warming, no recesses are employed. Although the recesses aid in the air flow, the insole and its channels defined on the bottom of the insole have efficacy without these additional structures.

The bottom layer preferably defines an indentation in the heel area adapted to receive a heel pad. The insole preferably further comprises a heel pad secured within said indentation to said bottom layer. Most preferably, the heel pad is concave.

Referring to FIG. 10 and FIG. 12, the concave heel pad (102) has outside heel ridges (120), inside heel ridges (121) and heel channel portions (123).

When concave heel pad (102) is positioned in the heel recess defined by bottom layer (112), the heel channel portions (123) are essentially coplanar with the channel lining portions (103) of the bottom layer (112).

Each inside heel ridge (121) is essentially curvilinear in shape and has a front end (121A), a back end (121B) and a middle portion (121C). The front end (121A) and back end (121B) each have a sufficient thickness so that when the concave heel pad (102) is in place in said heel recess, each of said front and back ends of the inside heel ridges thereof are situated adjacent the ridges (106) of bottom layer (112), and they are of similar thickness to ridges (106) and appear essentially continuous. The middle portion (121C) of the inside heel ridges (121) comprises the top of the curvilinear shape when the insole is in use and is of a thickness less than that of the ends, so the curve gradually changes in thickness. It has a greatest thickness at the ends and the least thickness at the middle portion. The outside heel ridges (120) each have a front and back end and maintain the same thickness from said front end to said back end.

The curvilinear shape of the inside heel ridges (121) is advantageous because it allows more air to be displaced by a heel strike of a user. The shape formed is a cup-like area in which air may accumulate prior to the heel strike of the user.

Referring to FIG. 12, the preferred configuration for the air channels (103) and ridges (106) is shown. Concave heel pad (102) is secured to insole (101) within the recess defined by heel portion (111).

As air is displaced it is projected into the air channels toward the toe and heel portions of the insole. As the user's foot progresses from heel strike to toe off, the air channels collapse under the weight of the user and air is moved toward the forefoot. This air movement assists in the even distribution of warm air within an enclosed shoe. During periods of inactivity, the air channels trap air and provide additional insulation to help in heat retention.

The concave heel pad (102) has outside heel ridges (120), inside heel ridges (121) and heel channel portions (123).

When concave heel pad (102) is positioned in the heel recess defined by bottom layer (112), the heel channel portions are essentially coplanar with the channel lining portions (103) of the bottom layer (112).

Each inside heel ridge (121) is essentially curvilinear in shape and has a front end (121A), a back end (121B) and a middle portion (121C). The front end (121A) and back end (121B) each have a sufficient thickness so that when the concave heel pad is in place in said heel recess, each of said front and back ends of the inside heel ridges thereof are situated adjacent the ridges (106) of bottom layer (112), and they are of similar thickness to ridges (106) and appear essentially continuous. The middle portion (121C) of the inside heel ridges (121) comprises the top of the curvilinear shape when the insole is in use and is of a thickness less than that of the ends, so the curve gradually changes in thickness. It has a greatest thickness at the ends and the least thickness at the middle portion. The outside heel ridges (120) each have a front and back end and maintain the same thickness from said front end to said back end.

The curvilinear shape of the inside heel ridges (121) is advantageous because it allows more air to be displaced by a heel strike of a user. The shape formed is a cup-like area in which air may accumulate prior to the heel strike of the user.

Figure 13:
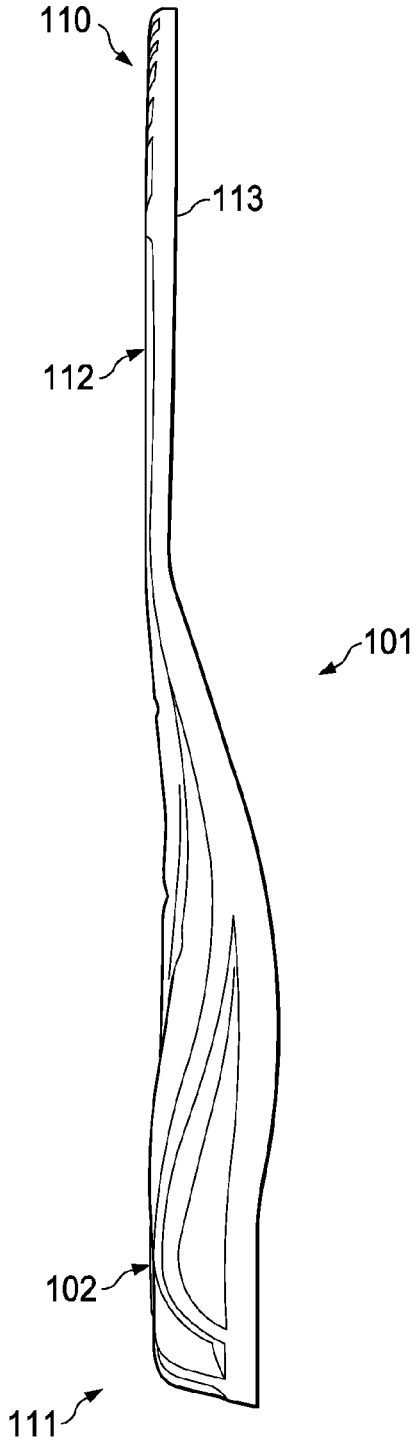
FIG. 13 is a left side view of an insole designed for warming the right foot of a wearer.
Figure 14:
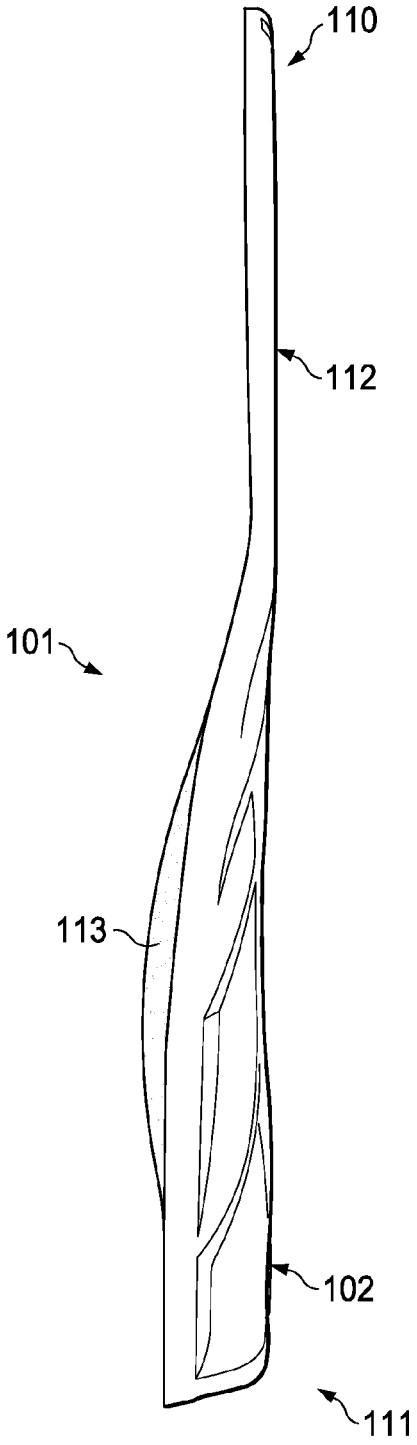
FIG. 14 is a right side view of an insole designed for warming the right foot of a wearer.

FIGS. 13 and 14 show the side views of the insole.

Referring to FIG. 15, a front view of the insole (101) is shown and toe portion (110) is a reference point. In this view, the layers of the insole (101) are best seen. The top layer (113) is secured to the middle layer (115) which is in turn secured to the bottom layer (112).

Figure 16:
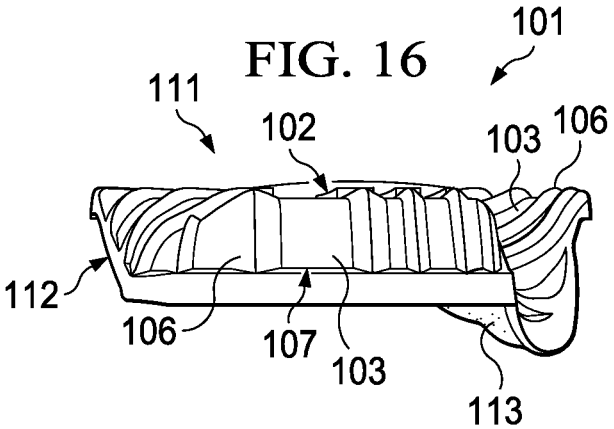
FIG. 16 is back side view of the heel area of an embodiment of the present invention designed for warming the right foot of a wearer.

Referring to FIG. 16, the heel portion (111) is shown from an end view of insole 101). The heel portion (111) has a shape suitable to support and cradle the heel of a user and prevent it from rolling or sliding within the shoe.

Most preferably, the concave heel pad of the warming embodiment is made of a polyurethane ("PU") material. A Shore/Asker Hardness test provides a measure of hardness. In a most preferred embodiment, the layer measures 45 Asker C±3. Alternative materials such as TPR gel can be considered for the heel pad.

Figure 11:
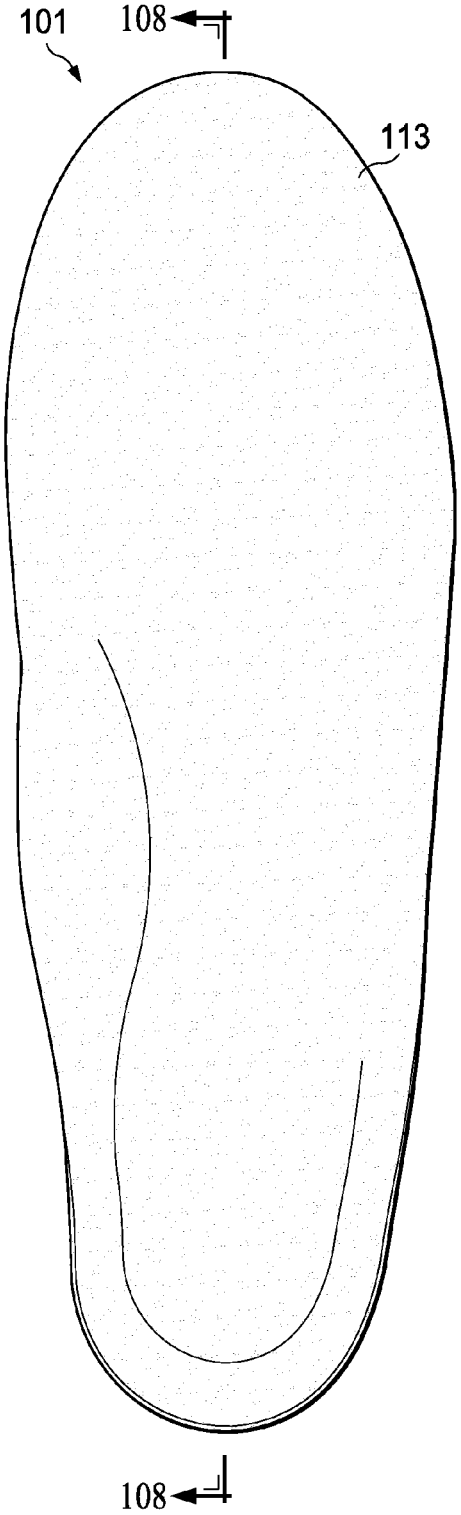
FIG. 11 is a top view of an embodiment of the present invention designed for warming the right foot of a wearer.
Figure 17:
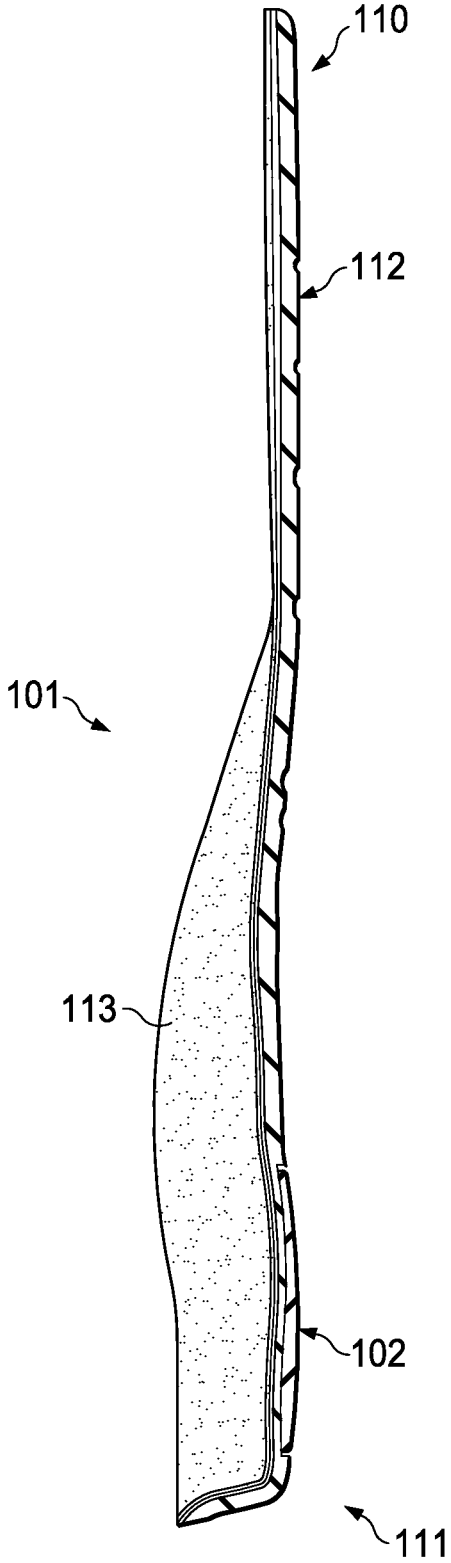
FIG. 17 is a cross-sectional view along the length line 108-108 of FIG. 11.

FIG. 17 is a cross section along line 108-108 of FIG. 11 which shows the three layers of the insole.

Figure 18:
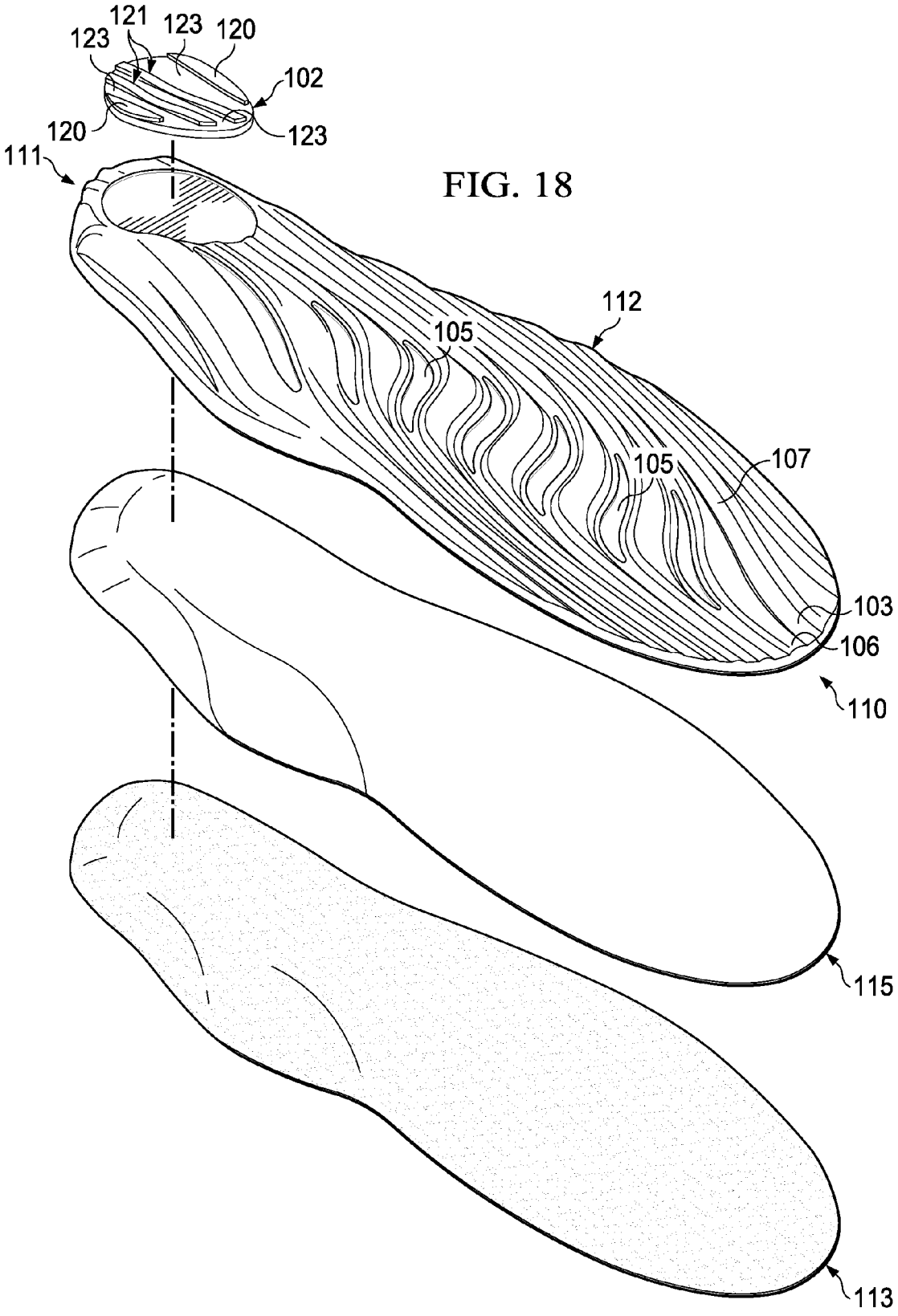
FIG. 18 is an exploded view of an embodiment of the present invention designed for warming the right foot of a wearer.

FIG. 18 is an exploded view showing top layer (113), middle layer (115), bottom layer (112) and a concave heel pad (102).

The total thickness and size of the insole can vary depending on the size of the shoe in which the insole is intended to be used. In an exemplary men's insole for a standard men's 10-11 (United States) shoe size, the thickest part of the toe area is about 0.24 inches and the thickest part of the arch area is about 0.43 inches. This exemplary insole is about 11.75 inches in length and has a width of about 2.70 inches near the heel and 3.86 inches near the metatarsal region. The height of the insole is from about 0.24 inches near the toe portion to 0.91 inches near the heel portion. It should be understood that the length and width of the insole will vary according to the shoe size for which the insole is intended, but the thickness in the same relative area will be similar to the exemplary insole and the areas corresponding to the heel, toe and forefoot for the various sizes defined in the art.

A thinner insole for use in selected shoe styles may be provided to accommodate essentially the length and width dimensions above but said insole has reduced thickness dimensions. For example, the reduction in thickness of the bottom layer may range from 002 inches to 0.082 inches. In one exemplary thinner insole having a length of about 11.75 inches and a width of about 2.70 inches near the heel and 3.86 inches near the metatarsal region, the thickest part of the toe area is about 0.15 inches and the thickest part of the arch area is about 0.36 inches. It can be appreciated that these exemplary dimensions may be adapted to work in conjunction with particular footwear styles as long as the function of the insole is retained.

We claim:

1. An insole which enables generation of an air flow to or from the plantar surface of the foot during use, said insole comprising:

a. a bottom layer having a top side and a bottom side, a heel portion and a toe portion, said heel portion on said bottom side defining a heel recess of sufficient depth and configuration so as to be adapted to receive a heel pad, said bottom side of said bottom layer further defining a plurality of ridges which protrude outwardly therefrom and extend essentially lengthwise from the heel portion to the toe portion, wherein said bottom layer further defines a channel lining portion, wherein adjacent ridges and said channel lining portions define air channels, whereby when said insole is placed adjacent the inside bottom surface of a user's shoe, a portion of the ridges contact the inside shoe surface, thus sealing said air channels against that surface and forming individual pathways in which air can travel from a first location to a second location within said air channels; and b. a heel pad situated in said heel recess.

2. The insole of claim 1, further comprising a middle layer having a thermal reflective barrier and having an upper surface and a lower surface, said lower surface of said middle layer secured to said top side of said bottom layer.

3. The insole of claim 1, further comprising a top layer comprising a substrate for foot contact, said top layer secured to the top side of said bottom layer.

4. The insole of claim 2, further comprising a top layer comprising a substrate for foot contact, said top layer secured to the upper surface of said middle layer.

5. The insole of claim 3, wherein said top layer comprises a fabric that assists in thermal regulation of the foot.

6. The insole of claim 5, wherein said fabric comprises jadeite.

7. The insole of claim 1, wherein said bottom layer comprises an ethylene vinyl acetate ("EVA").

8. The insole of claim 7, wherein said EVA is thermally conductive, to help transfer the heat away from the foot.

9. The insole of claim 8, wherein said EVA further comprises magnesium oxide.

10. The insole of claim 8, wherein said EVA further comprises boron nitride.

11. The insole of claim 1, wherein said heel pad is concave.

12. The insole of claim 11, wherein said concave heel pad comprises inside heel ridges that protrude outwardly therefrom and extending essentially lengthwise and heel channel portions that are coplanar with said channel lining portions of said bottom layer, said inside heel ridges configured in a curvilinear shape and having a front end, a middle portion and a back end, wherein the thickness of said front and back ends of said inside heel ridges are greater than that of said middle portion of said inside heel ridges.

13. The insole of claim 12, wherein said concave heel pad further comprises outside heel ridges which are essentially uniform in thickness.

14. The insole of claim 11, wherein at least some of the air channels are in communication with said concave heel pad.

15. The insole of claim 1, wherein said bottom layer further defines recesses which are located along said air channels.

16. The insole of claim 3, wherein said top and bottom layers further define air vent holes which communicate from said top to said bottom layer.

17. The insole of claim 16, wherein said air vent holes are conical in configuration and have a wider end and a narrower end.

18. The insole of claim 17, wherein said wider end is adjacent said bottom side of said bottom layer and said narrower end is adjacent said top side of said bottom layer.

19. The insole of claim 1, wherein said bottom layer has a hardness of about 45 Asker C±3.

20. The insole of claim 11, wherein said heel pad has a hardness of about 45 Asker C±3.

21. The insole of claim 4, wherein said top layer is 100% polyester and incorporates a phase change material.

22. The insole of claim 1, wherein said bottom layer comprises polyurethane.

23. An insole which enables generation of an air flow to or from the plantar surface of the foot during use, said insole comprising:

a. a bottom layer having a top side and a bottom side, a heel portion and a toe portion, said heel portion on said bottom side defining a heel recess of sufficient depth and configuration so as to be adapted to receive a heel pad, said bottom side of said bottom layer further defining a plurality of ridges which protrude outwardly therefrom and extend essentially lengthwise from the heel portion to the toe portion, wherein said bottom layer further defines a channel lining portion, wherein adjacent ridges and said channel lining portions define air channels, whereby when said insole is placed adjacent the inside bottom surface of a user's shoe, a portion of the ridges contact the inside shoe surface, thus sealing said air channels against that surface and forming individual pathways in which air can travel from a first location to a second location within said air channels, said bottom layer being thermally conductive to help transfer heat away from the foot; and b. a heel pad situated in said heel recess.

24. The insole of claim 23, wherein said bottom layer comprises an ethylene vinyl acetate ("EVA").

25. The insole of claim 23, further comprising a top layer comprising a substrate for foot contact, said top layer secured to the top side of said bottom layer.

26. The insole of claim 25, wherein said top layer comprises a fabric that assists in thermal regulation of the foot.

27. The insole of claim 26, wherein said fabric comprises jadeite.

28. An insole which enables generation of an air flow to or from the plantar surface of the foot during use, said insole comprising:

a. a bottom layer having a top side and a bottom side, a heel portion and a toe portion, said heel portion on said bottom side defining a heel recess of sufficient depth and configuration so as to be adapted to receive a heel pad, said bottom side of said bottom layer further defining a plurality of ridges which protrude outwardly therefrom and extend essentially lengthwise from the heel portion to the toe portion, wherein said bottom layer further defines a channel lining portion, wherein adjacent ridges and said channel lining portions define air channels, whereby when said insole is placed adjacent the inside bottom surface of a user's shoe, a portion of the ridges contact the inside shoe surface, thus sealing said air channels against that surface and forming individual pathways in which air can travel from a first location to a second location within said air channels;

a middle layer having an upper surface and a lower surface, said lower surface of said middle layer secured to said top side of said bottom layer, said middle layer helping to capture and retain heat; and b. a heel pad situated in said heel recess.

29. The insole of claim 28, further comprising a top layer comprising a substrate for foot contact, said top layer secured to the upper surface of said middle layer.

30. The insole of claim 29, wherein said top layer is 100% polyester and incorporates a phase change material.

31. The insole of claim 28, wherein said bottom layer comprises polyurethane.

* * * * *